US006290595B1

(12) United States Patent
Daunay

(10) Patent No.: US 6,290,595 B1
(45) Date of Patent: Sep. 18, 2001

(54) DEVICES CONTROLLING AND REGULATING AN AIR FLOW

(75) Inventor: Jacques Daunay, Sainte-Adresse (FR)

(73) Assignee: SPIREC (Societe Anonyme), Argenteuil (FR)

( * ) Notice: Subject to any disclaimer, the term of this patent is extended or adjusted under 35 U.S.C. 154(b) by 0 days.

(21) Appl. No.: 09/508,887

(22) PCT Filed: Sep. 18, 1998

(86) PCT No.: PCT/FR98/02005

§ 371 Date: Mar. 20, 2000

§ 102(e) Date: Mar. 20, 2000

(87) PCT Pub. No.: WO99/15839

PCT Pub. Date: Apr. 1, 1999

(30) Foreign Application Priority Data

Sep. 19, 1997 (FR) ..... 97 11689

(51) Int. Cl.[7] ..... F24F 13/04
(52) U.S. Cl. ..... 454/264; 137/864
(58) Field of Search ..... 454/261, 264, 454/286, 323, 334; 137/901, 864

(56) References Cited

U.S. PATENT DOCUMENTS 1,319,526 * 10/1919 Hauser ..... 454/262
2,579,507 * 12/1951 MacCracken ..... 454/262
3,058,664 * 10/1962 Donahue ..... 454/262
3,981,326 9/1976 Gorchev .
5,413,530 * 5/1995 Montaz ..... 454/262

FOREIGN PATENT DOCUMENTS 1235224 10/1960 (FR) .
WO 92/17740 10/1992 (WO) .

* cited by examiner

*Primary Examiner*—Harold Joyce
*Assistant Examiner*—Derek S. Boles
(74) *Attorney, Agent, or Firm*—Young & Thompson

(57) ABSTRACT

A device for regulating the temperature of premises by a secondary air flow blown therein, comprises an upstream duct communicating with elements for supplying pressurized air, ending in a converging element emerging into a downstream duct communicating with the premises. The device is characterized in that a substantially rotating solid, capable of being positioned along the convergent element longitudinal axis, is arranged at least partially upstream of the outlet thereof, so as to define between the substantially rotating solid outer surface and the convergent element inner wall with a ring-shaped channel the size of which depends on the position of the solid relative to the wall.

11 Claims, 2 Drawing Sheets

DEVICES CONTROLLING AND REGULATING AN AIR FLOW

CROSS REFERENCE TO RELATED APPLICATION

This is the 35 USC 371 national stage of international application PCT/FR98/02005 filed on Sep. 18, 1998, which designated the United States of America.

1. Field of the Invention

The present invention relates to improvements to devices intended for ensuring temperature regulation of a plurality of premises with the aid of a single incidental air flow at given pressure and temperature, it also concerns a device for controlling the flow parameters of a pulsed air flow in a premises.

2. Background of the Invention

It is known that one of the essential difficulties in the domain of air conditioning is that of delivering to a series of premises, of which the calorie needs are very different from one another, from a single supply furnishing air at a determined pressure and temperature, the quantities of air and the calories/negative calories which are necessary for each of these premises.

In this type of installation, it is usual to adjust the quantity of calories/negative calories which is distributed to a specific premises by controlling the air flow rate which is supplied thereto. The difficulty comes from the fact that it is possible to vary this air flow rate only in very narrow proportions as, on the one hand, one is obliged in any case to maintain in the premises a minimum air flow rate, called hygienic flow rate, and, on the other hand, in particular for reasons of comfort of the premises, this air flow rate cannot be increased beyond a reasonable value without causing discomfort for the users.

One solution consists in calling upon so-called induction supply means, in which there is blown via a convergent central duct a certain air flow, called primary air, coming from the power plant which entrains by induction a secondary air flow which is extracted from the premises, and it is the resulting flow, namely the one constituted by the primary air flow and the secondary air flow, which is blown into the premises. It is thus possible, by reason of the resulting thermal equilibrium of the mixture of these two air flows, to call upon primary air whose extreme temperatures (minimum or maximum) are respectively lower or higher than those acceptable in the premises.

Applicant has observed that, if the flow rate of the primary air is varied, the corresponding variation of the air blown into the premises is not proportional to this variation but is below it. For example, when the primary air flow rate is reduced, the quantity of air blown into the premises is reduced in a lesser proportion. It has thus been ascertained that, in one embodiment, for a primary air flow rate passing from 115 $m^3$/hr. to 26 $m^3$/hr. (or a ratio of 4.4), the flow rate of blown air passed from 340 $m^3$/hr. to 230 $m^3$/hr. (or a ratio of 1.5). Under these conditions, since the calories/negative calories which are supplied to a premises are brought thereto by the primary air, it is thus possible to reduce the quantity of calories/negative calories brought to this premsies while maintaining therein the air flow which is necessary for the comfort of its occupants. Conversely, it is also possible to increase the quantity of calories/negative calories supplied to the premises without blowing therein an air flow such that it would cause discomfort to its occupants by reason of the considerable differences in temperature between the blown air and the air of the premises.

It has been proposed, in particular in Patent EP-A-0531508, to arrange upstream of a convergent element used in an air-conditioning installation employing induction means, air flow rate control means which are constituted by a register system comprising a flap with which the primary duct is more or less obturated as a function of the flow rate which it is desired therefor. The flow rate control means of this type present the drawbacks, on the one hand, of considerably disturbing the quality of the flow and thus of reducing the efficiency of the device and, on the other hand, of generating a very considerable noise. Now, it is known that one of the essential qualities of an air-conditioning installation is precisely to be able to restore in a premises a given air flow at a given temperature, with a sound level which is as low as possible.

SUMMARY OF THE INVENTION

The present invention has for an object to propose improvements to air-conditioning systems, whether or not they call upon induction means, making it possible to adjust the flow rate of the primary air without provoking serious disturbances on the one hand at the level of the flow of the air flux and, on the other hand, at the level of the noise generated by the installation.

The present invention thus has for its object a device regulating the temperature of premises by means of an air flow blown therein, comprising an upstream duct communicating with means supplying pressurized air, ending in a convergent element emerging into a downstream duct communicating with the premises, characterized in that a substantially rotating solid, capable of being positioned along the longitudinal axis of the convergent element, is arranged at least partially upstream of the outlet thereof, so as to define between the outer surface of the substantially rotating solid and the inner wall of the convergent element a ring-shaped channel the size of which depends on the position of said solid relative to said wall.

The convergent element will preferably be of circular cross-section. The cross-section of the convergent element may also be of polygonal shape, and the substantially rotating solid may have a cross-section of the same shape in order to provide between these two elements a stream of air of substantially constant thickness.

However, according to the invention, the cross-sections of the convergent element and of the substantially rotating element may equally well be of different shapes so as to provide therebetween a minimum outlet section.

In an embodiment of the invention, the maximum outer diameter of said substantially rotating solid is slightly larger than that of the downstream orifice of the convergent element.

This solid may be constituted in particular by a sphere or, preferably, by a cone or conical frustum of which the upstream part is of rounded, and even semi-spherical shape.

The solid may be maintained inside the convergent element by a rod axial thereto. This rod may be threaded so as to be screwed in a fixed ring forming a nut, which enables it to be positioned axially with respect to the convergent element. Maintenance in position may be ensured by a counter-nut. Interestingly, the ring forming nut may be maintained by a device diffusing the air streams, the latter itself being able to be constituted by a heat exchanger making it possible to adjust the temperature of the air delivered by the convergent element.

The substantially rotating solid may also be adjustably mounted inside the convergent element. Such an embodiment makes it possible, when this is desirable, to modify during operation the axial position of the substantially rotating solid. It is thus possible, without dismantling the installation, to vary the air flow rate in considerable proportions, possibly going as far as total obturation of the outlet orifice, which then enables non-used premises not to be treated (heated or cooled).

The present device is in particular adapted to function jointly with induction means and, to that end, the downstream duct will comprise, downstream of the convergent element, means for communication with a suction orifice arranged in the premises.

The present device is also interesting in an installation in which the ratio of the cross-section of the outlet orifice of the convergent element with respect to the cross-section of the downstream duct is included between 0.06 and 0.50, the downstream duct being closed from the outside in its upstream part, so that it gives rise to a peripheral air flow designated in the present Patent by "internal induction".

BRIEF DESCRIPTION OF THE DRAWINGS

Forms of embodiment of the present invention will be described hereinafter by way of non-limiting example, with reference to the accompanying drawings, in which.

DESCRIPTION OF THE PREFERRED EMBODIMENT

Figure 1:
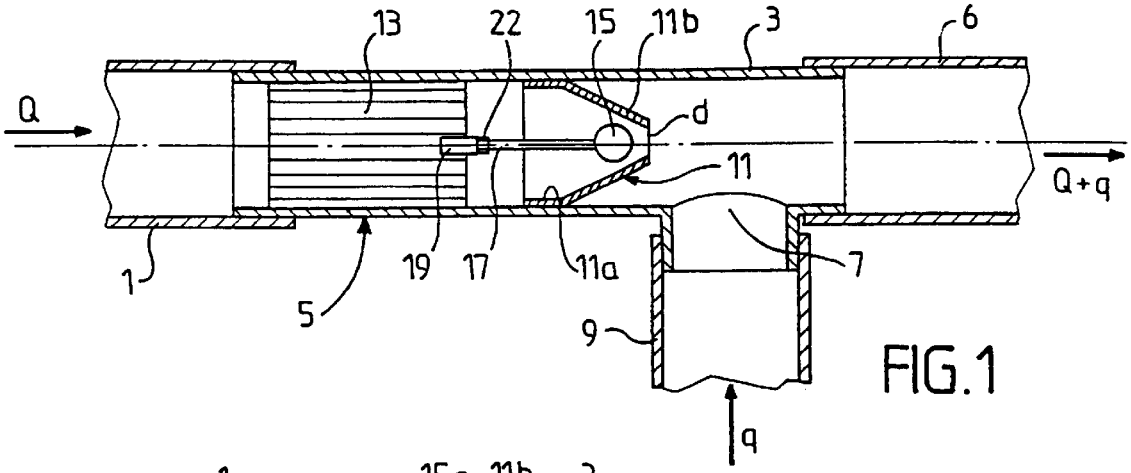
FIG. 1 is a view in horizontal and longitudinal section of a first embodiment of the invention.

FIG. 1 shows a supply duct 1 of circular cross-section of which the upstream end is in communication with an air-conditioning plant (not shown in the drawing) and of which the other end receives by fit the upstream end of a conduit element 5 whose downstream part 3 is positioned in a duct 6 in communication with the premises to be treated. The downstream part 3 of the conduit element 5 comprises an orifice 7, of transverse axis, which is in communication by a duct 9 with the premises to be treated. A convergent element 11 is disposed in the conduit element 5. This element 11 comprises a cylindrical part 11*a* followed by a convergent part 11*b* of outlet diameter d. The conduit element 5 also receives an air stream diffuser element 13 which, in the present example, is advantageously constituted by a heat exchanger making it possible, in addition, to adjust the temperature of the air which traverses it, and consequently of the air delivered by the convergent element 11.

The device functions in known manner in accordance with the principles of induction. A flow rate Q, coming from the power plant (called primary air flow rate) is blown under a pressure P and at a temperature T, into the diffuser/exchanger element 13, then into the convergent element 11 from which it emerges to suck by induction a certain air flow rate q in the premises via the duct 9, which flow rate is blown into the premises with the primary air Q.

According to the invention, there has been arranged inside the convergent element 11 a rotating solid 15 of spherical shape which is fast with a rod 17, of which the end opposite the solid 15 is provided with a threading. This latter allows screwing of the free end of the rod 17 in a threaded sleeve 19 arranged at the centre of the diffuser/exchanger 13. The longitudinal positioning of the solid 15 is ensured by screwing the threaded part of the rod 17 more or less in the sleeve 19. Said solid is maintained in the determined chosen position by immobilisation means such as in particular a counter-nut 22.

Figure 2:
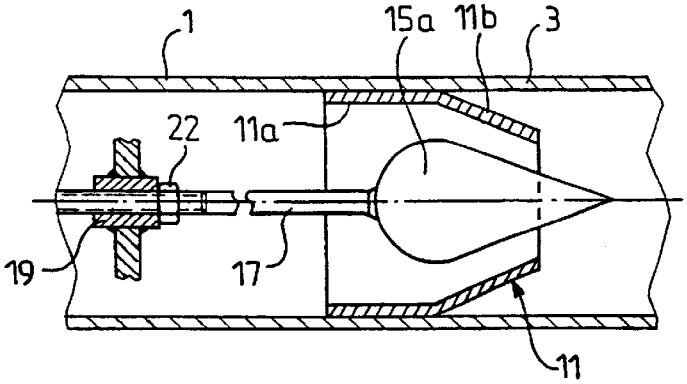
FIG. 2 is a view in partial longitudinal section on a larger scale of a variant embodiment of the invention, the substantially rotating solid being in position of opening.
Figure 3:
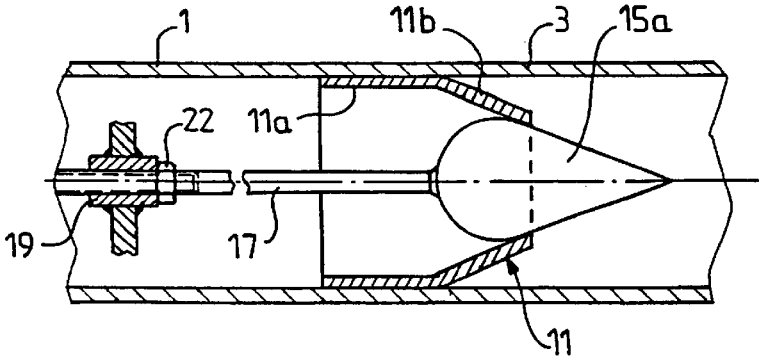
FIG. 3 is a partial longitudinal sectional view of the variant shown in FIG. 2, the substantially rotating solid being in position of obturation of the convergent element.

As shown in FIGS. 2 and 3, the solid 15*a* may also be constituted by a cone of which the upstream face is semi-spherical in shape, and the possible stroke of the threaded rod 17 may be sufficient to ensure complete obturation of the outlet orifice of the convergent element 11. This form of embodiment of the invention thus makes it possible in particular to stop blowing in unoccupied rooms, which represents a saving at the level of the operational costs of the installation.

It has been observed that such a shape of rotating solid was particularly efficient both from the standpoint of a good flow of the air streams and from that of silence in operation.

Measurements of noise emission were thus made on such a device. The latter presented the following mechanical characteristics:

inner diameter of the downstream duct 3: 125 mm conicity of the convergent element 11: 21° outer diameter of the semi-spherical part of the rotating element 15*a*: 50 mm conicity of the rotating element 15*a*: 21°.

A premises (not shown in the drawing) was supplied with an air flow corresponding to the maximum flow rate capable of being furnished by the device and which was 120 $m^3$/hr. It has been observed that, for this flow rate, the sound level attained in the premises was 31 dB(A). The rotating element 15*a* was then displaced so as to partially obturate the outlet orifice of the convergent element 11 and obtain in the premises a flow rate of 50 $m^3$/hr. It was then observed that the noise level generated in the premises was 30 dB(A), viz. a value less than what it was previously. The rotating element 15*a* was then displaced so as to obturate the outlet orifice of the convergent element 11 virtually completely and the noise level generated by the device in the premises was measured, which was then 30.5 dB(A), i.e. a value lower than the noise level at full flow rate. By way of comparison, it will be noted that the flow rate reducer devices of the prior state of the art, such as those with iris or mobile flaps, attain, for identical operating conditions, sound levels of the order of 40 dB(A) to 45 dB(A).

Contrary to the devices of the prior state of the art, such a flow rate reducer device produces during operation a noise level which not only does not increase in position of total or partial obturation, but, on the contrary, decreases.

The device according to the invention thus proves particularly interesting for effecting reductions of air flow rate when it is desired that such reduction of flow rate be effected under particularly silent conditions.

Figure 6:
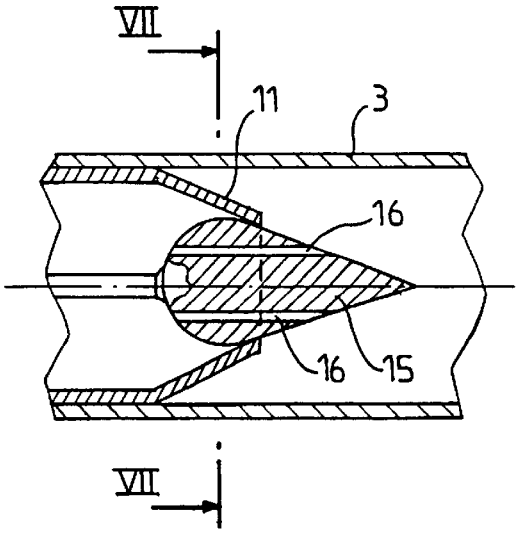
FIG. 6 is a view in partial longitudinal section of a variant embodiment of the invention.
Figure 7:
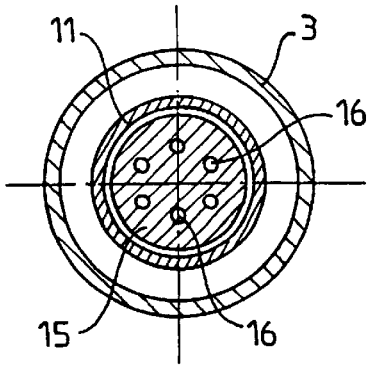
FIG. 7 is a view in transverse section of FIG. 6 along line VII—VII thereof

In order to be in a position to blow into the premises a minimum air flow rate, called hygienic air flow rate, it is possible, as shown in FIGS. 6 and 7, to provide in the solid 15 longitudinal conduits 16 whose total section of passage is able to create a primary air flow ensuring said minimum flow rate in the premises.

Figure 4:
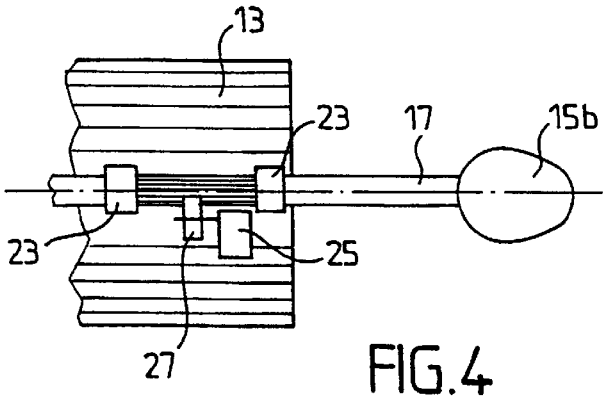
FIG. 4 is a partial longitudinal sectional view on a larger scale of a second variant embodiment of a device according to the invention.

In an embodiment of the invention shown in FIG. 4, the positioning of the rotating solid 15*b* with respect to the convergent element 11 may be controlled without having to intervene technically on the installation. To that end, the diffuser/exchanger element 13 is provided in its central part with two threaded rings 23 in which is screwed the threaded rod 17 which supports the rotating solid 15*b*. A motor 25 drives in rotation a pinion 27 which is in mesh with that part of the threaded rod 17 included between the two rings 23. By rotating the motor 25 in one direction or in the other, the displacement of the solid 15 in one direction or in the other and therefore the positioning thereof at the chosen place of the convergent element, are thus obtained.

It is, of course, possible, within the framework of the present invention, to use rotating solids presenting shapes different from those described hereinbefore. A solid of the type shown in FIG. 4 might for example be employed, i.e. an element of substantially truncated shape whose ends are of semi-spherical shape, which might be interesting in certain forms of embodiment from the standpoint of space requirement.

Figure 5:
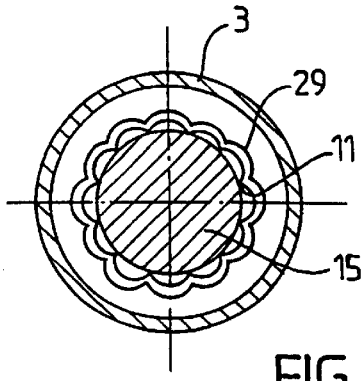
FIG. 5 is a view in transverse section at the level of the outlet of a convergent element of a variant embodiment of the invention.

In an embodiment of the invention shown in FIG. 5, the convergent element 11 comprises on its periphery a series of undulations 29 which may take various shapes and make it possible to increase the quantity of induced air. In effect, it is known that, in induction systems, these undulations make it possible to increase the surface of contact with the pulsed air, which improves the induction rate and the stability of the flow. In the present embodiment, when the rotating solid 15 is in position of obturation, as shown in FIG. 3, the outlet of the convergent element 11 is not totally obturated. An outlet surface may thus be provided which is sufficient to create a primary air flow making it possible to blow into the premises to be treated a sufficient flow to constitute the hygienic air flow.

According to the invention, a convergent element whose outlet orifice is perfectly circular may, of course, also be used, and a substantially rotating solid which has a series of grooves hollowed out therein, particularly of truncated shape, also making it possible to create, when the rotating solid is in extreme position, a minimum surface of passage for the primary air.

Figure 8:
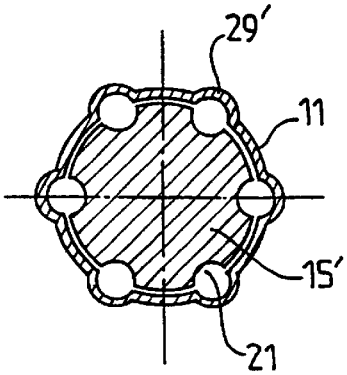
FIGS. 8, 8*a* and 8*b* are views in transverse section of three embodiments of the invention.
Figure 8A:
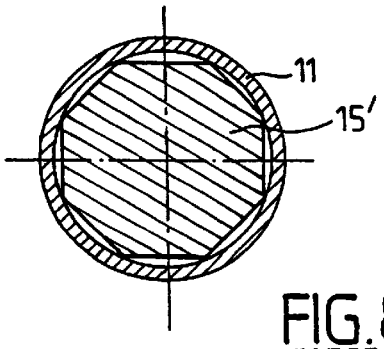

As shown in FIG. 8, it is possible to use a convergent element comprising undulations 29' and a rotating solid 15' provided with means for immobilization in rotation and which would comprise grooves 21 disposed opposite the undulations 29' in order to constitute therewith conduits making it possible to define, when the outer face of the solid 15' is in contact with the inner face of the convergent element 11, a minimum primary air outlet section. For the same purpose, as shown in FIG. 8*a*, it is also possible to call upon a substantially rotating solid 15' of which the cross-section is polygonal in shape, for example hexagonal, the cross-section of the convergent element 11 itself being of circular shape.

Figure 8B:
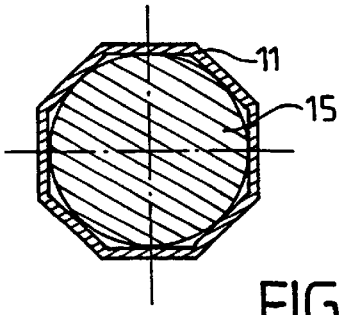

As shown in FIG. 8*b*, a convergent element 11 of polygonal cross-section and a rotating solid 15 of circular cross-section might also be called upon.

Figure 9:
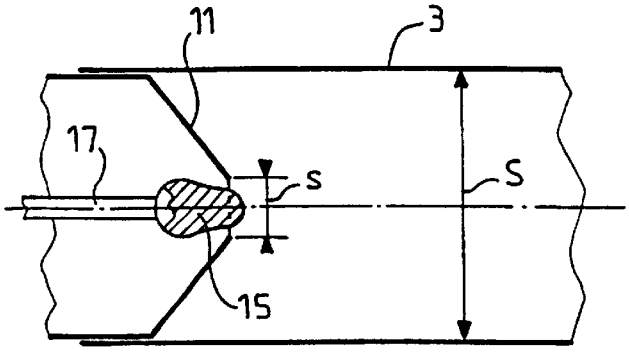
FIG. 9 is a view in partial longitudinal section of a variant embodiment of the invention.

As shown in FIG. 9, the present invention may also be carried out in an installation where the induction is effected in so-called "internal" fashion. In effect, it is known that, in this mode of induction, there is no orifice for supply of secondary air coming from the premises, but the outlet orifice of the convergent element is arranged to present a cross-section s much smaller than that of the duct 3 in which it opens out, so as to create at the level of the latter a return air current, called "internal induction". In such an embodiment, the ratio of the cross-section s of the outlet orifice of the convergent element 11 with respect to the cross-section S of the downstream duct 3 is included between about 0.06 and 0.50.

The present invention is also particularly interesting in more general applications not calling upon phenomena of induction.

In effect, it has been observed that, contrary to the flow rate reducing devices of the prior state of the art which, as mentioned above, are a source of considerable noise, the present invention made it possible to reduce the flow rate furnished by a convergent element without noteworthy increase in noise, and even, in certain embodiments, with a reduction thereof.

What is claimed is:

1. A device for regulating the temperature of premises by blowing an air flow in the premises, the device comprising:

a supply duct having a first end communicating with means for supplying pressurized air, and a second end;

a conduit element extending in the direction of a longitudinal axis and having an upstream end communicating with said second end, and a downstream end;

a convergent element positioned in said conduit element, and having an inner wall and an outlet orifice;

a substantially rotating solid body having an outer surface and positioned along said longitudinal axis; said solid body being structured and arranged at least partially upstream of said downstream end so as to define a ring-shaped channel between said outer surface and said inner wall; said ring-shaped channel having a size which depends on the position of said solid body relative to said inner wall;

an air stream diffuser positioned in said conduit element upstream of the convergent element; and a downstream duct having an inlet end communicating with said downstream end and an outlet end communicating with the premises.

2. The device according to claim 1, wherein the air stream diffuser comprises a heat exchanger for adjusting the temperature of the air delivered by the convergent element.

3. The device according to claim 1, wherein the convergent element has a circular cross-section.

4. The device according to claim 1, wherein the solid body has a maximum outer diameter which is slightly larger than that of the outlet orifice of the convergent element.

5. The device according to claim 1, wherein the solid body comprises a sphere.

6. The device according to claim 1, wherein the solid body comprises a substantially conical or truncated volume, having an upstream part which is rounded, and has a semi-spherical shape.

7. The device according to claim 1, wherein the solid body is maintained inside the convergent element by a rod axial thereto.

8. The device according to claim 1, wherein at least one of the inner wall of the convergent element and the outer surface of the solid body has such a shape so as to define therebetween a minimum outlet section.

9. The device according to claim 1, wherein the solid body is traversed by at least one longitudinal conduit for ensuring a minimum outlet section.

10. The device according to claim 1, wherein the ratio of the cross-section of the outlet orifice of the convergent element with respect to the cross-section of the downstream end ranges between about 0.06 and 0.50, and the downstream end is closed from the outside in its upstream part, so as to produce a peripheral flow, called "internal induction".

11. The device according to claim 1, wherein the downstream end comprises, downstream of the convergent element, means for communicating with a suction orifice arranged in the premises.

* * * * *